United States Patent [19]

Choi et al.

[11] Patent Number: 4,839,772

[45] Date of Patent: Jun. 13, 1989

[54] CAPACITIVE DISCHARGE ELECTRONIC IGNITION SYSTEM FOR AUTOMOBILES

[75] Inventors: Hyeong I. Choi, Evanston, Ill.; Keh-Kun Choi, Seoul, Rep. of Korea

[73] Assignee: Bang H. Mo, Chicago, Ill.

[21] Appl. No.: 171,460

[22] Filed: Mar. 21, 1988

[51] Int. Cl.[4] ..... F23Q 3/00; F02P 3/06

[52] U.S. Cl. ..... 361/256; 361/263; 123/604; 315/209 SC

[58] Field of Search ..... 123/604; 361/256, 263; 315/209 SC, 209 CD

[56] References Cited

U.S. PATENT DOCUMENTS 4,149,508 4/1979 Kirk, Jr. et al. ..... 123/604

4,763,045 8/1988 Choi et al. ..... 315/209 SC

FOREIGN PATENT DOCUMENTS 4538843 12/1967 Japan ..... 361/256

*Primary Examiner*—L. T. Hix

*Assistant Examiner*—David M. Gray

*Attorney, Agent, or Firm*—Birch, Stewart, Kolasch & Birch

[57] ABSTRACT

An apparatus for the generation of ignition voltage to a spark plug within an ingition system of an automobile includes an integrated circuit inverter for converting DC power source voltage into a high frequency voltage which is stepped-up by a transformer and rectified to charge a capacitor. The charge stored on the capacitor is discharged by applying a trigger pulse to a silicon controlled rectifier, through a high voltage ignition coil for igniting the spark gap of a spark plug. The trigger pulse is produced by a timing control circuit which utilizes a pre-existing timing signal of the ignition system to produce the trigger pulse. The secondary voltage of the ignition coil produces between 20,000 and 60,000 volts.

3 Claims, 4 Drawing Sheets

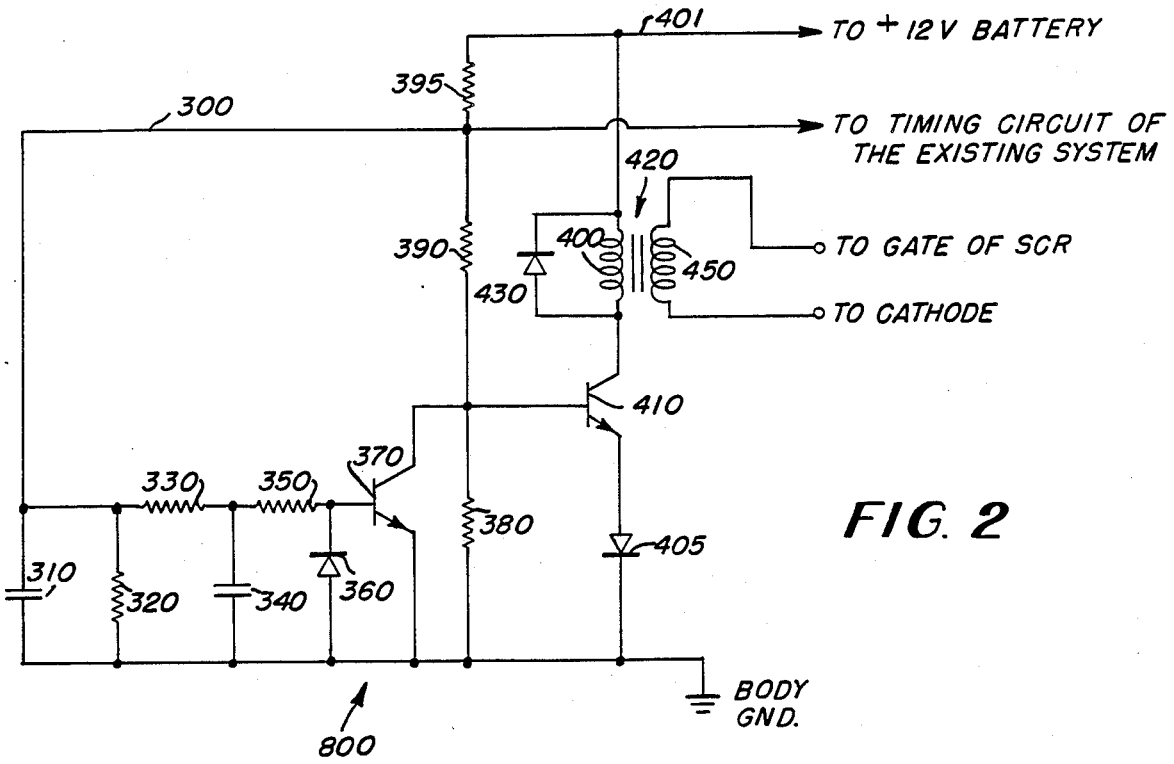
FIG. 2
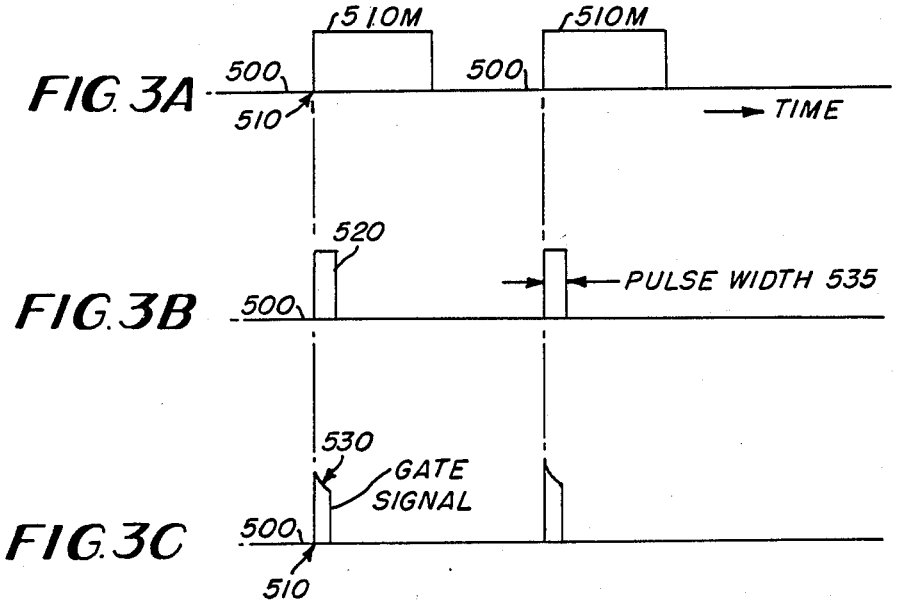
FIG. 3A
FIG. 3B
FIG. 3C

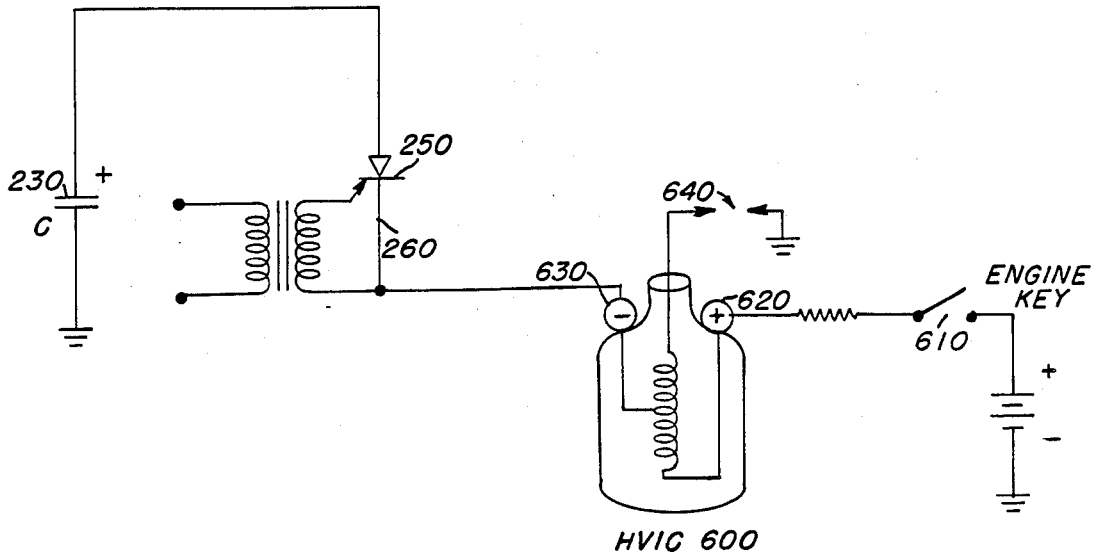
FIG. 4
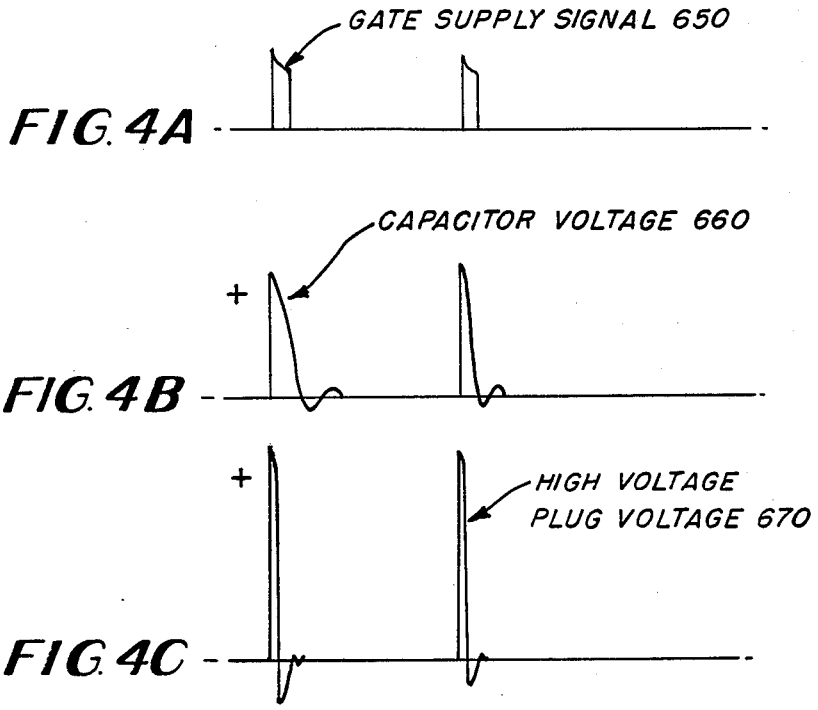

CAPACITIVE DISCHARGE ELECTRONIC IGNITION SYSTEM FOR AUTOMOBILES

BACKGROUND OF THE INVENTION

This invention relates generally to systems for providing ignition voltage to the spark plugs in an automobile, and more particularly to an electronic apparatus for charging and discharging a high voltage capacitor across a high voltage ignition coil of a spark plug.

The conventional and widely used capacitor discharge ignition system includes an inverter circuit with a simple passive feedback network, which unfortunately is not very stable particularly in cold weather starting, and therefore is not very reliable.

Consequently, a need in the art exists for an improved capacitive discharge ignition system which is reliable and exhibits stable performance characteristics.

SUMMARY OF THE INVENTION

Accordingly, it is a primary object of the present invention to provide a capacitive discharge ignition system which can deliver an adequate ignition voltage to a spark plug.

It is another object of the present invention to provide a capacitive discharge electronic ignition system which is stable and reliable even during cold weather.

It is a further object of the present invention to provide a capacitive discharge electronic ignition system which prevents false triggering of a spark plug.

These and other objects of the present invention are fulfilled by providing an apparatus for providing ignition voltage to a spark plug in an ignition system, comprising:

- integrated circuit inverter means for producing a high frequency voltage from a DC power source;
- transformer means for stepping up the high frequency voltage from said invertor means;
- rectified means for rectifying the stepped up voltage form said transformer;
- capacitor means, connected to said rectifier means, for storing a high voltage charge developed from said rectified voltage;
- ignition coil means, connected to said spark plug, for developing an ignition voltage;
- switch means, connected between said capacitor means and said ignition coil means, for discharging said capacitor means through said ignition coil means upon activation by a trigger pulse; and
- timing means for producing a trigger pulse for activating said switch means, said timing means utilizing a pre-existing timing signal of said ignition system to produce said trigger pulse.

These and other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BREIF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a circuit diagram of the timing control circuit 800 of FIG. 1;

Figure 1:
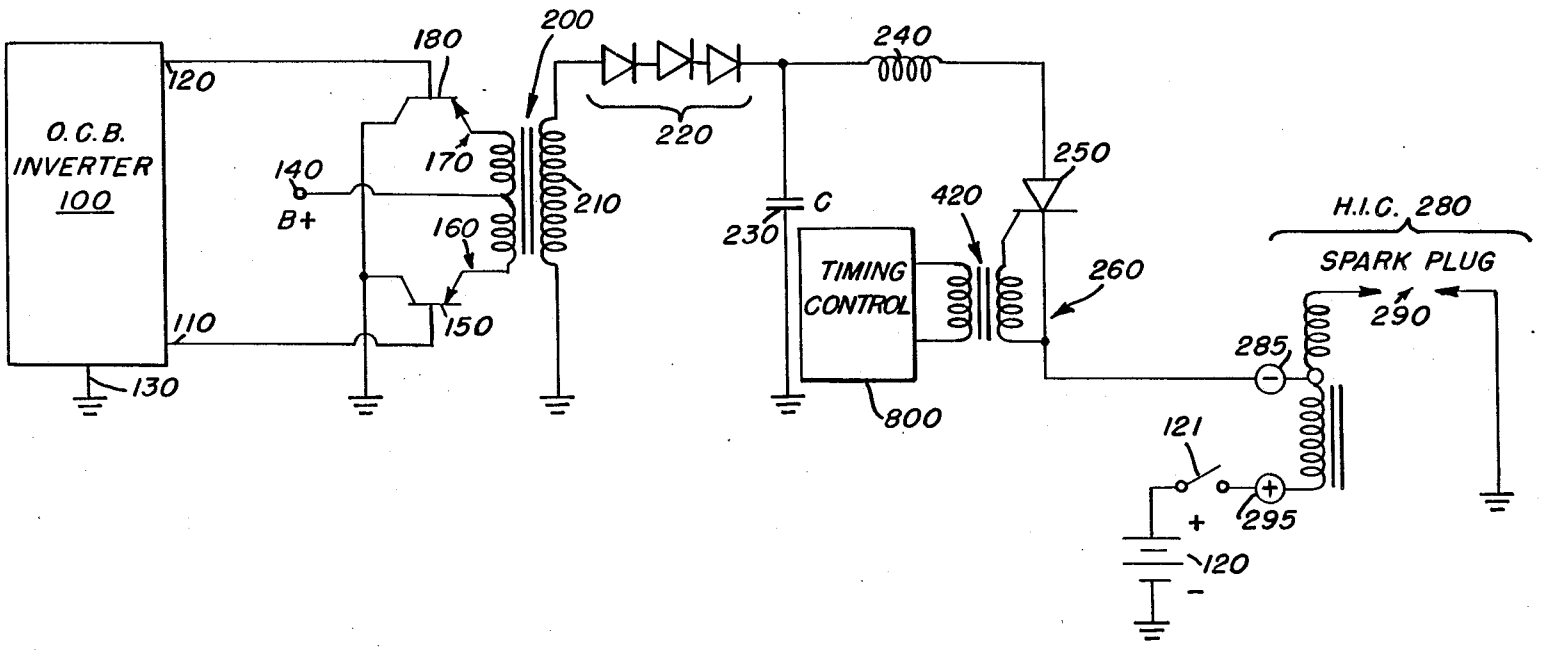
FIG. 1 is a schematic circuit diagram of one preferred embodiment of the present invention.
Figure 5A:
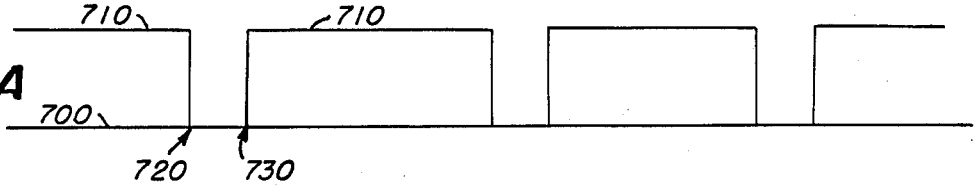
Figure 5B:
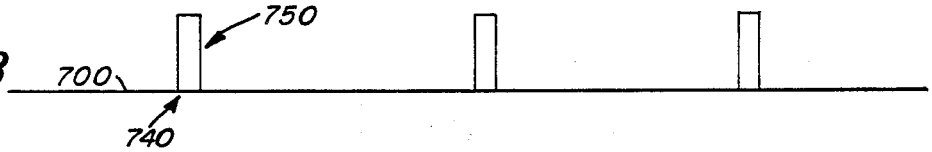
Figure 6:
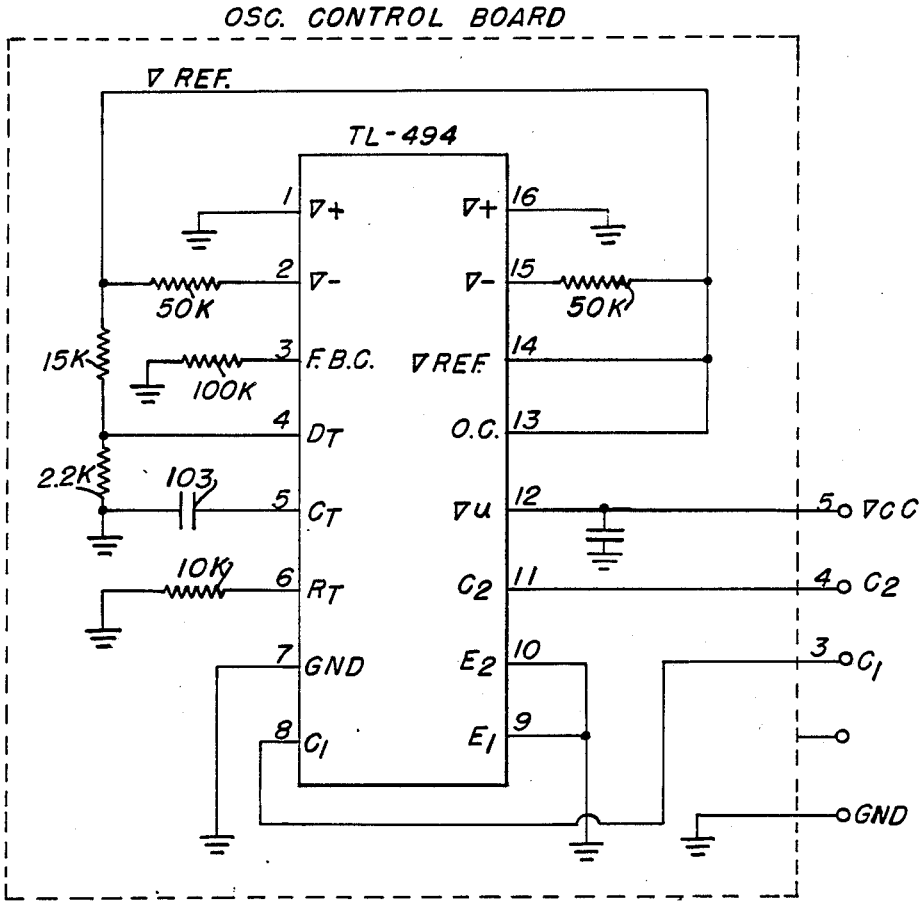

FIGS. 3(A) to 3(C) are waveforms explaining the operation of the timing control circuit of FIG. 2;

FIG. 4 is a circuit diagram of a second preferred embodiment of the present invention;

FIGS. 4(A) to 4(C) are waveforms explaining the operation of the circuit of FIG. 4;

FIGS. 5(A) and 5(B) are waveforms illustrating the timing pulses for the circuit of FIG. 4; and FIG. 6 is a schematic diagram of a preferred embodiment for the oscillator control board inverter 100 of FIG. 1.

DETAILED DESCRIPTION OF PREFERRED EMBODIMENTS

FIG. 1 is a schematic diagram illustrating the concept of a preferred embodiment of the present invention wherein element 100 is an integrated circuit oscillator control board which generates a rectangular waveform at lines 110 and 120 in such a manner so as to draw current through lines 110 and 120 in an alternating manner. The currents drawn through lines 110 and 120 originate from B+ terminal 140, which is connected to the DC power source of the system, such as a 12 volt battery 120. As current is drawn through lines 110 and 120 to ground 130, PNP transistors 150 and 180 draw a large emitter-to-collector current alternately through the primary coil of step-up transformer 200 to develop a high alternating voltage at a secondary winding 210. This high alternating voltage is rectified by diodes 220 and charges a high DC voltage to a capacitor 230. A timing control circuit 800 which develops a trigger pulse from the existing timing signal of the system, energizes pulse transformer 420 to activate SCR 250 such that the capacitor voltage is entirely discharged via an inductor 240 through the SCR 250 and line 260 to the primary winding of high voltage ignition coil 280 which voltage is stepped up through the secondary winding of coil 280 to provide an ignition voltage to spark plug 290 to ignite the spark gap. As shown, the capacitor voltage is applied to the negative terminal 285 of the primary winding of ignition coil 280, while the positive terminal 295 thereof is connected to the 12 volt battery 120 through the ignition key switch 121.

Timing control circuit 800 is shown in FIG. 2. 12 volt power is supplied from the battery through a line 401. A timing signal from a timing circuit of the existing ignition system is supplied to line 300 and is fed to the base of a transistor 370 through a delay network consisting of capacitors 310 and 340, and resistors 320, 330 and 350. The collector of transistor 370 is connected to the base of transistor 410, the collector of transistor 410 being connected to the primary winding 400 of pulse transformer 420, with the secondary winding 450 being connected to the gate and cathode of SCR 250 as shown in FIG. 1. The base of transistor 410 is also connected to the timing signal on line 300 through resistor 390 and is connected to ground through resistor 380. A diode 405 is connected between the emitter of transistor 410 and ground, in order to provide a proper threshold triggering voltage of triggering of transistor 410. Additionally, diode 430 is connected across primary winding 400 of the pulse transformer 420 which helps to shape the pulse waveform to the SCR and also allows the dissipation of excess energy storage in pulse transformer 420.

FIGS. 3(A) to 3(C) illustrate the operation of the timing control circuit 800 of FIG. 2. FIG. 3(A) illustrates the waveform of a timing signal produced by the timing circuit of the existing system at an instant 510 appearing on line 300. The numeral 500 denotes the ground level and the numeral 510M denotes the high voltage level. At the time 510, the high voltage pulse 510M is applied to the base of transistor 410 and to the play network coupled to the base of transistor 370. Since this pulse is delayed, transistor 370 remains off, while transistor 410 is turned on. FIG. 3(B) illustrates a pulse 520 produced by transistor 410 in response to the delayed timing signal applied to the base thereof via transistor 370 in conjunction with the pre-existing timing signal appearing at the base of transistor 410 via resistor 390. As is apparent from FIGS. 3(A) and 3(B), the delay network has a delay time equal to the pulse width 535 of the pulse 520 output by the transistor 410. The pulse width 535 of pulse 520 is much narrower than the width of timing signal 510M produced by the existing timing system. FIG. 3(C) illustrates gate signal 530 appearing at the secondary winding 450 of pulse transformer 420, which gate signal is supplied between the gate and cathode of SCR 250 as shown in FIG. 1, to thereby activate SCR 250.

FIG. 4 is a schematic diagram of a second preferred embodiment of the present invention wherein high voltage ignition coil 600 is a center tapped coil with positive and negative terminals 620 and 630 respectfully. Positive terminal 620 is connected to the battery via engine key 610. FIG. 4(A) illustrates the gate supply signal 650 developed by pulse transformer 420 to activate SCR 250. FIG. 4(B) illustrates the capacitor voltage 660 which is discharged from capacitor 230 to the negative terminal of ignition coil 600. FIG. 4(C) illustrates the polarity of the voltage developed across spark plug 640 to thereby ignite the spark gap. The high voltage spark voltage 670 is in the range of between 20,000 to 60,000 volts.

FIGS. 5(A) and 5(B) are waveforms explaining a second preferred timing operation in which the trigger pulse 750 as shown in FIG. 5(B) occurs at a time instant 740 which lies between the falling edge 720 and the rising edge 730 of timing signals 710. As shown in FIG. 5(A) level 700 represents the ground level. This timing scheme is preferred since the gate signal to the SCR 250 is produced between successive time signals, to thereby prevent the possibility of false triggering of the capacitor discharge. The timing signal format as shown in FIG. 5(A) and 5(B) is accomplished with only a slight modification of the timing control circuit 800 as shown in FIG. 2, as is apparent to those skilled in the art.

FIG. 6 is a schematic diagram of the oscillator control board 100 of FIG. 1. Since this circuit is a commercially available integrated chip corresponding to ICTL-494, a more detailed explanation is not provided herein.

The invention being thus described it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. Apparatus for providing ignition voltage to a spark plug in an ignition system, comprising:

inverter means for producing a high frequency voltage from a DC power source;

transformer means for stepping-up the high frequency voltage from said inverter means;

rectifier means for rectifying the stepped-up voltage from said transformer;

energy storage means, connected to said rectifier means, for storing a high voltage charge developed from said rectified voltage;

ignition coil means, connected to said spark plug, for developing an ignition voltage;

switch means, connected between said energy storage means and said ignition coil means, for discharging said energy storage means through said ignition coil means upon activation by a trigger pulse, said ignition coil including primary and secondary coils, said primary coil having a positive terminal connected to said DC power source and a negative terminal connected to said switch means, said secondary coil being connected to said spark plug;

timing means for producing a trigger pulse for activating said switch means, said timing means including transistor means connected to said DC power source for producing said trigger pulse;

delay means for triggering said transistor means in response to said pre-existing timing signal; and diode means in circuit with said transistor means for providing a triggering threshold level for said transistor means for utilizing a pre-existing timing signal of said ignition system to produce said trigger pulse.

2. Apparatus according to claim 1, wherein said inverter means comprises a semiconductor integrated circuit.

3. Apparatus according to claim 1, wherein said energy storage means comprises a capacitor.

* * * * *